United States Patent [19]

Berger

[11] 4,017,991

[45] Apr. 19, 1977

[54] DISPLAY CLIP FOR POINT OF PURCHASE DISPLAYS

[76] Inventor: Sol J. Berger, 310 Melvin Drive, Northbrook, Ill. 60062

[22] Filed: Aug. 29, 1974

[21] Appl. No.: 501,475

[52] U.S. Cl. ..... 40/128; 40/145 R

[51] Int. Cl.[2] ..... G09F 7/22

[58] Field of Search ..... 40/10, 145 R, 125 H, 40/128

[56] References Cited

UNITED STATES PATENTS

| | | | |
|---|---|---|---|
| 193,302 | 7/1877 | Vieira | 40/145 R |
| 482,178 | 9/1892 | Irish | 40/39 |
| 1,284,909 | 11/1918 | Rose et al. | 40/145 |
| 1,603,311 | 10/1926 | Brett et al. | 40/145 R |
| 3,030,718 | 4/1962 | Kirkman | 40/138 |
| 3,204,355 | 9/1965 | Whitman | 40/145 R |
| 3,339,752 | 9/1967 | Trogan | 248/121 |
| 3,550,784 | 12/1970 | Batts | 211/116 |
| 3,613,881 | 10/1971 | Oldenburg | 206/820 X |
| 3,634,965 | 1/1972 | McAuley | 40/17 |
| 3,665,625 | 5/1972 | Moss | 40/126 R |

FOREIGN PATENTS OR APPLICATIONS

| | | | |
|---|---|---|---|
| 1,140,970 | 3/1957 | France | 40/145 |

*Primary Examiner*—Hugh R. Chamblee
*Assistant Examiner*—Wenceslao J. Contreras
*Attorney, Agent, or Firm*—Morris Spector

[57] ABSTRACT

This invention relates to a display which is used to convey information or attract attention at a point of purchase of products. The display includes means for receiving and holding two or more display sheets in a balanced relationship. It includes essentially a rod-like central structure, having two or more socketing arms symetrically spaced and each adopted to receive and hold a display panel or other eye-catching object. The central rod has means at one end thereof for suspending it and alternate means at the opposite end for mounting it on a pole or column, in a manner such that it may oscillate or swing, thereby producing a mobile effect.

13 Claims, 6 Drawing Figures

DISPLAY CLIP FOR POINT OF PURCHASE DISPLAYS

OBJECTS OF THE INVENTION

This invention relates to a point of purchase display which can receive banners, flags, individual display mobiles, decorations, greeting cards, Christmas tinsel, or other display material for attracting attention.

It is one of the objects of this invention to make a display which can receive a variety of panels, banners or other display materials and may readily be suspended from a cord or mounted on top of a pole, as a pole display, and which is likely to sway or swing due to air currents to produce a mobile effect. It is a further object of this invention to provide a display of the above character wherein the "eye attracting" suspended material may be easily removed and replaced.

It is still a further object of this invention to provide a unit of the above-mentioned character wherein the parts are so made that they can be economically packaged for transmission to the customer who is to use them.

The attainment of the above and further objects of this invention will be explained in the following specification and taken in conjunction with the drawings forming a part therein.

DRAWINGS

In the accompanying drawings reference numerals represent like parts throughout.

Figure 1:
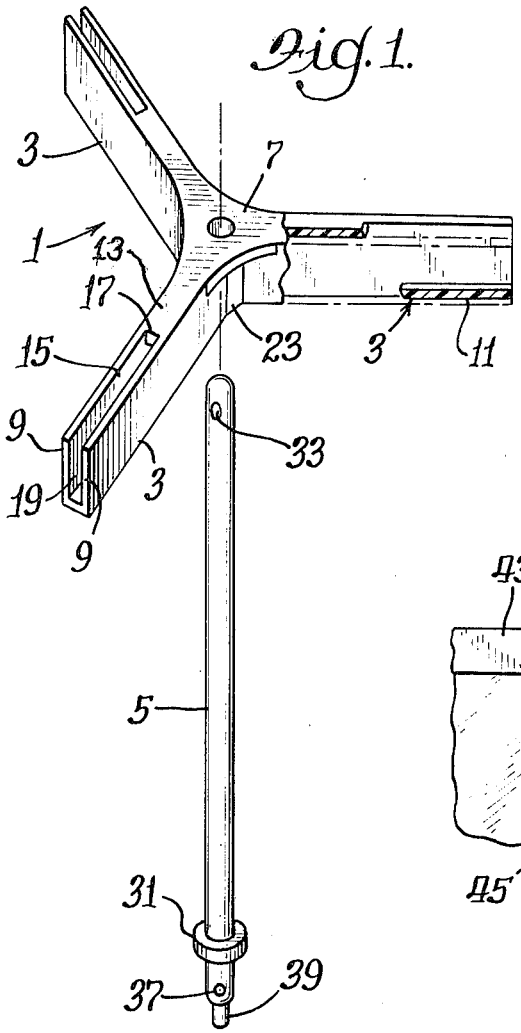
FIG. 1 is an exploded view of two parts of the mounting unit being assembled.
Figure 2:
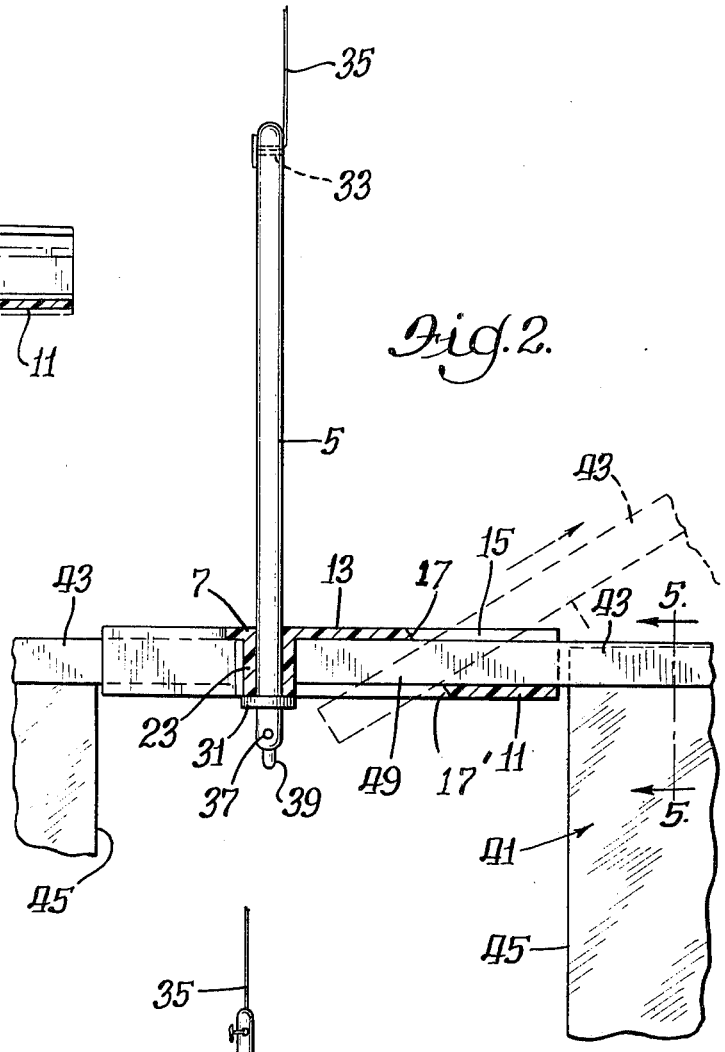
FIG. 2 is an enlarged sectional view through one of the arms of the assembled unit.

The display unit comprises a spider 1 which has radiating arms 3, in this instance, three in number, constituting a three armed socket adapted to be supported by a rod or stem 5. The spider 1 includes a center portion 7 from which the arms radiate. The center lines of the arms are 120° apart.

Each arm 3 comprises a pair of parallel supporting walls 9—9 joined at their outer ends by a bottom ledge 11 at their inner ends by a top ledge 13, leaving a slot 15 extending from the point 17 to the outer end of the arm, thus forming open top socket 19. The walls 9—9 of each arm are joined at the center of the unit by a sleeve 23 which is open at the top and bottom, and also is integral with the top 7. Each set of arms 9—9 thus has two oppositely facing channels, namely, an open top channel 19 forming a socket at the radially outward ends of each set of arms 9—9, and an open bottom, closed top channel between the sleeve 23 and the bottom ledge 11. The radially outer edge 17 of the top ledge 13 is substantially closer to the sleeve 23 than is the radially inner edge 17' of the lower ledge 11.

The three armed spider 1 is adapted to be supported by the cylindrical rod or stem 5 that is inserted through the hole in the sleeve 23. The rod 5 has an integrally formed shoulder 31 that limits the extend to which the rod may be inserted into the hole in the sleeve, which shoulder supports the spider or socket 1 on the rod 5. The upper end of the rod 5 has a hole 53 therethrough through which a cord or barb 35 may be inserted for hanging the spider and the display that is suspended therefrom. The portion of the rod 5 above the shoulder is much longer than the length of a arm 3. The greater the distance between the collar 31 and the suspension hole 33 the smaller will be the tilt of the spider 1 in the event that the articles supported from the spider are not balanced. The rod or stem has a lower hole 37 from which an additional display 35 may be suspended by means of a cord or the like. In addition, the rod or stem 5 has a pin-like short projection 39 that acts as a bearing to support the unit when the unit is placed on a flat surface.

Figure 5:
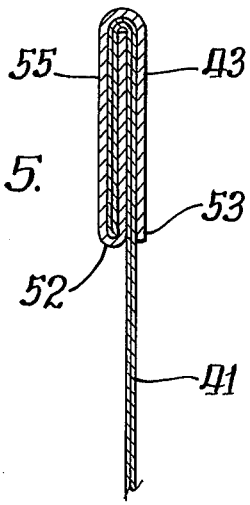
FIG. 5 is an enlarged section taken along the lines 5—5 of FIG. 2.

A panel or banner 41 of cloth or paper that may have printed matter thereon, or decorations, has a tinning support 43 along its upper edge for mounting the same as is usual. The tinning support comprises a long narrow piece of tin plate upon which the upper edge of the panel is laid and the assembly is then folded to form a double seam as shown in FIG. 5, securing the tinning support and the top of the panel together to form the banner. The tinning support 43 extends along the full top of the panel 41 and projects beyond one edge 45 of the banner as indicated at 49. The projecting portion 49 of the seam may be of a length of the order of a 1¾ inches. It is of a thickness sufficient to fit snugly into the slot 9, of the magnitude of ⅛ inches. The ends 52–53 of the steam of the tinning support at the portion 49 thereof which enters a socket arm 3 are open, being spaced apart by the thickness of the banner, and there is enough resiliency so that they may be slightly compressed by the fingers of the hand to facilitate insertion into the slot 15, and be retained therein by the spring pressure exerted by the tinning support against the inner surfaces of the side walls 9—9.

The portion 49 of the tinning support constitutes a plug-in insert for any of the three sockets 19.

Figure 4:
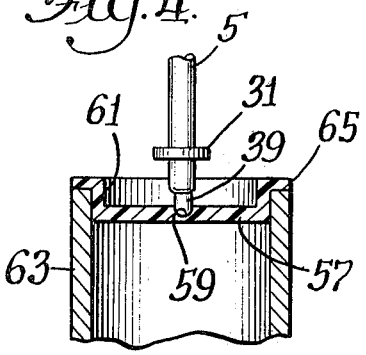
FIG. 4 shows the base of the unit of FIG. 3 supported on a pole.
Figure 3:
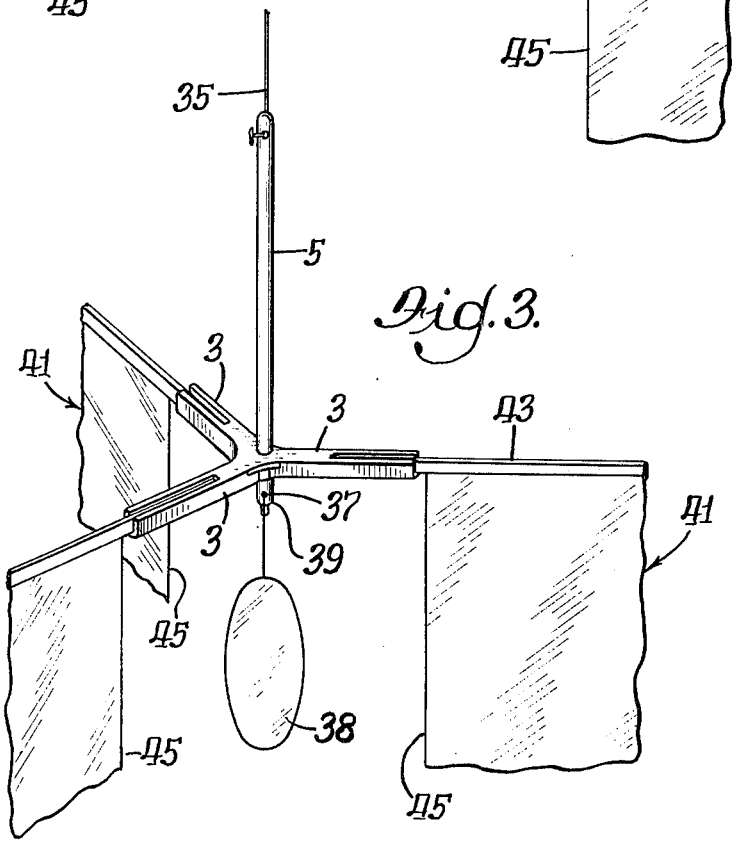
FIG. 3 shows the unit of FIG. 2 suspended.

If the unit is to be supported from a pole instead of suspended from the cord 35, there is provided a circular disc 57 that may have a center circular depression 59 therein, and in which the projecting bearing 39 of the rod 5 seats as shown in FIG. 4. The disc 57 has a cylindrical flange 61 that may fit snugly into the top center of a circular tubular pole 63 as for instance of cardboard or the like. The cylindrical portion 61 terminates in a peripheral circular rim 65 that seats on the top of the pole 63.

Figure 6:
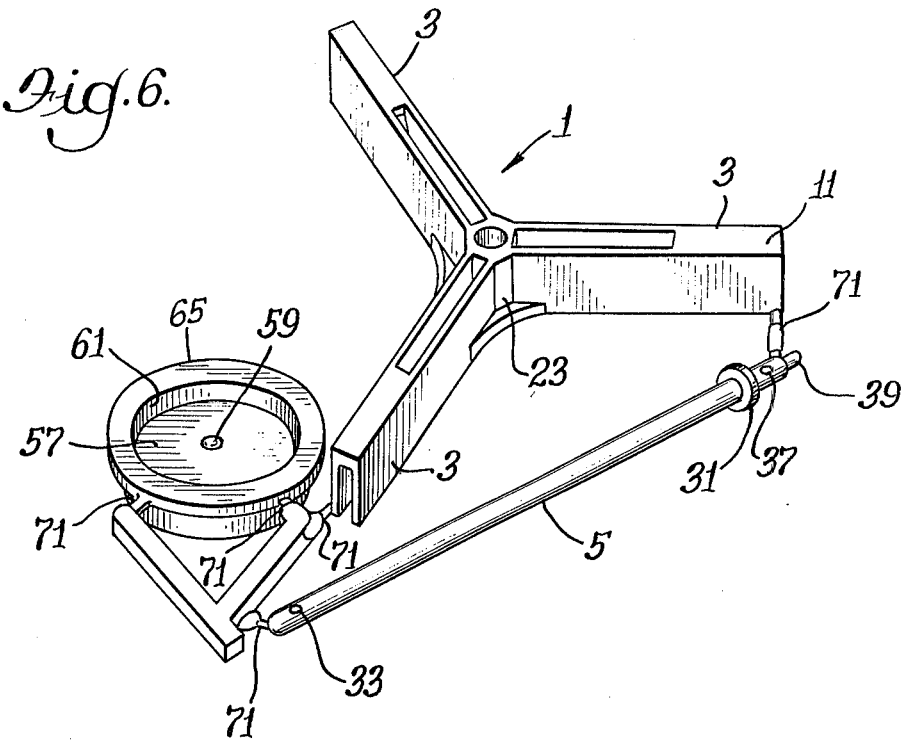
FIG. 6 is a top perspective view of the plastic parts as intially molded, shown in a position upside down with respect to the showing of FIG. 1.

The parts 1, 5 and 57 are all made of plastic. They may be molded in a single operation as one piece as illustrated in FIG. 6. The three parts 1, 5 and 57 are joined by frangible bridges 71. The customer can readily break the frangible portions 71, throwing away the surplus material.

I claim:

1. A one piece molded article comprising (1) an element having arms uniformly spaced fron one another about a common center, each arm having at its outer end a socket for receiving a display, and said element having means at the common center of the arms for mounting the element and (2) a rod of the same shape at both ends and having means for cooperating with said common center mounting means for supporting the element on the rod and (3) a disc; said element, rod and disc being joined into one unitary structure by frangible bridges that permit molding of the article as a unit and thereafter separating them by fracturing the bridges, each arm comprising a pair of side by side spaced apart parallel side walls extending from said common center, the bottom edges of the side walls being joined at one end of the side walls and the top edges of the side walls being joined at opposite ends of the side walls, and the space between the side walls being open at the end opposite the common center, the means at the center of the mounting element for supporting the element comprising a hole therethrough for receiving either end of the rod, and the means on the rod for supporting the element comprising a shoulder on the rod, said shoulder being adjacent to one end of the rod.

2. The article of claim 1 wherein the distance from the shoulder to the far end of the rod is at least several times as great as the distance from the shoulder to the adjacent end of the rod.

3. A display unit comprising a substantially rigid element having a central portion with a centrally located stem-receiving opening and with arms extending therefrom symetrically with respect to one another and symetrically with respect to the opening, a central supporting stem extending through the opening upwardly and downwardly therefrom, each arm having at its radially outward end a socket the longitudinal axis of which is at right angles to the longitudinal axis of the stem-receiving opening, said socket comprising a rectangular slot at the top thereof extending from the far end of the arm radially towards the center but terminating short of the center, decorative display banners each having a supporting bar across the top thereof and a banner display portion secured to and depending from the bar with at least one end of the supporting bar projecting beyond the end of the display portion, the projecting ends of the respective bars extending one into each of the respective slots of the respective arms, and extending radially outwardly of the respective arms, said central portion having means for preventing tilting of the bars in the respective slots.

4. A unit of claim 3 wherein said supporting stem comprises a rod insertable through a central hole and having a shoulder on which the bottom of the element bears.

5. A unit of claim 4 wherein the rod has means at the top thereof for suspending the rod to support said element.

6. A unit of claim 5 wherein the bottom of the rod has means for suspending and object therefrom.

7. A unit of claim 4 wherein the bottom of the rod terminates in a centrally located pin bearing for balancing the element on a support.

8. A free-swinging mobile display unit comprising a substantially rigid central portion having substantially identical socket-arms radiating therefrom symetrically with respect to one another and each arm being open at its radially end, the radially innermost ends of the longitudinal axes of respective socket arms lying in a common plane and each arm having at its top adjacent to said outer end spaced apart side walls joined by top and bottom ledges of which the top ledge terminates short of the radially outermost ends of the side walls to leave a top slot extending from the top ledge to the radially outermost part of the side walls, the radially innermost part of the bottom ledge terminates at a distance from the radially outward end of the arm which is less than the length of the top slot to have a bottom slot extending radially inwardly from the bottom ledge and with the top slot overlapping the bottom slot, and means at the rigid central portion forming a free-swinging suspension for the unit, said last means including a rod extending into said central portion.

9. A unit of claim 8 wherein the means for suspending it comprises a central opening in the central portion thru which opening either end of the rod is slidable, and said common plane being at right angles to the central axis of the central opening.

10. A unit of claim 9 wherein the rod has similar suspension means at its opposite ends on opposite sides of the shoulder.

11. A unit of claim 10 wherein the end of the rod closest to the shoulder terminates in a mounting bearing projection.

12. A unit of claim 10 wherein the distance from the shoulder to the far end of the rod is at least several times as great as the distance to the near end of the rod.

13. A unit of claim 9 wherein the distance from the shoulder to the far end of the rod is at least several times as great as the distance to the near end of the rod.

* * * * *